United States Patent [19]

Rosman et al.

[11] Patent Number: 4,519,745

[45] Date of Patent: May 28, 1985

[54] ROTOR BLADE AND STATOR VANE USING CERAMIC SHELL

[75] Inventors: Irwin E. Rosman, Woodland Hills, Calif.; Hector S. Bourgeois, Monument Beach, Mass.

[73] Assignee: Rockwell International Corporation, El Segundo, Calif.

[21] Appl. No.: 397,267

[22] Filed: Jul. 12, 1982

Related U.S. Application Data

[63] Continuation-in-part of Ser. No. 188,646, Sep. 19, 1980, abandoned.

[51] Int. Cl.[3] ..... F01D 5/18

[52] U.S. Cl. ..... 416/96 A; 416/92; 416/241 B

[58] Field of Search ..... 416/96 A, 241 B, 92, 416/96, 97 (U.S. only)

[56] References Cited

U.S. PATENT DOCUMENTS

| | | | |
|---|---|---|---|
| 2,787,441 | 4/1957 | Bartlett | 416/96 A X |
| 2,851,216 | 9/1958 | Scanlan et al. | 416/96 A X |
| 2,994,124 | 8/1961 | Denny et al. | 416/96 A X |
| 3,389,889 | 6/1968 | Denny | 416/92 |
| 3,443,792 | 5/1969 | Moss | 416/92 |
| 4,396,349 | 8/1983 | Hueber | 416/241 B X |

FOREIGN PATENT DOCUMENTS

| | | | |
|---|---|---|---|
| 1007303 | 5/1952 | France | 416/96 A |
| 57426 | 1/1953 | France | 416/92 |
| 602530 | 5/1948 | United Kingdom | 416/96 A |

*Primary Examiner*—Everette A. Powell, Jr.

*Attorney, Agent, or Firm*—H. Fredrick Hamann; Harry B. Field

[57] ABSTRACT

A ceramic blade assembly including a corrugated-metal partition situated in the space between the ceramic blade element and the post member, which corrugated-metal partition forms a compliant layer for the relief of mechanical stresses in the ceramic blade element during aerodynamic and thermal loading of the blade and which partition also serves as a means for defining contiguous sets of juxtaposed passages situated between the ceramic blade element and the post member, one set being open-ended and adjacent to exterior surfaces of the post member for directing cooling fluid thereover and the second set being adjacent to the interior surfaces of the ceramic blade element and being closed-off for creating stagnant columns of fluid to thereby insulate the ceramic blade element from the cooling air.

17 Claims, 8 Drawing Figures

ROTOR BLADE AND STATOR VANE USING CERAMIC SHELL

This application is a continuation-in-part of copending application Ser. No. 188,646, filed Sept. 19, 1980, and abandoned on Oct. 25, 1982.

BACKGROUND OF THE INVENTION

1. Field of the Invention

This invention relates to turbomachinery and is particularly directed to turbomachinery having ceramic shields as thermal protection for blades and vanes for high-temperature operation.

2. Description of the Prior Art

In order to improve the performance and fuel economy of turbomachinery, such as pumps or turbines, it has been proposed to operate the turbines at elevated turbine inlet temperatures. Inlet temperatures above 2400° F. are theoretically desirable. However, such temperatures are well above the operating capabilities of even the most advanced high-strength metals unless complex and costly cooling methods are applied to the blades' exterior surfaces.

Blades comprising high-temperature ceramics have exhibited great potential for fulfilling the goal of accommodating high turbine inlet temperatures without requiring the use of complex surface cooling methods. However, since ceramics are brittle and have little capacity for withstanding mechanical or thermally induced tensile stresses, various significant problems arise in connection with the application of ceramics to turbine blade and stator vane design.

A typical example of a ceramic turbine blade constructed according to the prior art can be found in U.S. Pat. No. 2,749,057 to Bodger which discloses a turbine rotor having a row of blades, each blade comprising a central post integral with the rotor and a hollowed ceramic blade element of airfoil shape mounted onto the post. A cap member is affixed to the outer tip of the post which serves as an abutment to the ceramic shield against centrifugal movement. During rotation, the ceramic blade element bears against and is supported by the cap member so that tensile loading of the ceramic blade element is avoided. Among the other features disclosed in Bodger include a central cooling duct through the post for effecting cooling of the post's exterior surfaces.

Because it is the exterior surface of the post where cooling is most needed, it has been found that the use of a central cooling duct as taught in Bodger requires prohibitively large volumes of cooling air in order to be effective. An alternative arrangement in the prior art attempts to avoid this shortcoming by directing cooling air through a gap between the ceramic blade element and the post, as exemplified by the device shown in FIG. 1 of French Pat. No. 57,426 to Bolsezian, wherein cooling air is ducted directly from the rotor hub. However, such device requires that the ceramic blade element be protected from the passing cooling fluid so that a destructive thermal gradient is not built-up in the ceramic blade element. Bolsezian attempts to accomplish this by coverng the interior surfaces of the ceramic blade element with a layer of thermally insulating material; however, such construction requires the difficult and costly step of bonding a layer of insulation directly to the interior ceramic blade element and makes the whole blade assembly vulnerable to failure upon breach of the insulatory layer, however slight the breach.

Another significant disadvantage of a blade constructed according to the prior art is that the ceramic blade element is restrained only at its footing and tip without means for dampening vibration or relieving aerodynamically induced stresses along the entire surfaces of the blade. For instance, in Bodger a rim at the tip of the ceramic blade element is provided for bearing against the cap in a manner resistive to the ceramic blade elements tendency to rotate when aerodynamically loaded. Such arrangment not only aggravates the risk of blade failure by subjecting the tip of ceramic blade element to localized, mechanical stresses but also fails to provide means for resisting such angular displacement uniformly across the whole span of the blade.

Additionally, since the ceramic blade element in either the Bodger-type or the Bosezian-type blade is supported only at its ends and is in close proximity to the post member, any transient or nodal vibration in either element might lead to one bearing against the other in a manner destructive of the ceramic blade element. This disadvantage is especially critical in blades constructed according to Bolsezian where the vibrationally-induced contact might breach the layer of insulation.

Of the more troublesome sources of vibration is the flutter created each time a turbine blade traverses in proximity to one of turbine inlet vanes comprising the turbine stage. Because each vane acts somewhat like a baffle, each turbine blade is subjected to a high rate of cyclical variation in aerodynamic loading as each blade proceeds from one of the more baffled regions of flow to one of the less baffled regions of flow and back again. These circumstances present significant problems to one constructing a viable ceramic blade element because cyclical fatigue is a principal mode of failure for ceramic materials. Unless means are taken to dampen this cyclical flutter failure is likely to occur.

Practitioners of the prior art seem intent on overcoming these problems by thickening the walls of the ceramic blade elements so that they are more resistive to the vibration induced stresses. However this solution creates further problems of its own in that, as a ceramic element is made thicker, it is caused to carry a greater and greater thermal gradient across its thickness, which, in the realm of turbine flow temperatures, can lead to the creation of destructive levels of internal stresses. So it appears that the thickening of the ceramic blade element is a disadvantageous means for overcoming the problems associated with vibration and a more effective alternative is most desired.

OBJECTS OF THE INVENTION

In view of these disadvantages in the prior art, an object of the present invention is to provide an improved ceramic turbine blade and vane.

Another object of the present invention is to provide a ceramic turbine blade having cooling air directed at the exterior surfaces of the post member without applying a layer of insulatory material to interior surfaces of the ceramic blade element.

Another of the objects of the present invention is to provide a ceramic turbine blade having means for evenly distributing stresses along the entire surfaces of the blade.

Still another object of the present invention is to provide a ceramic turbine blade which is resistent to the destructive effects of vibration within the blade.

Another object of the present invention is to provide a ceramic turbine blade having a ceramic blade element of minimal thickness so that the thermal gradient thereacross is minimized.

Still another object of the present invention is to provide a ceramic turbine blade having thin ceramic walls but which blade is resistive to damage from vibration and cyclic fatigue.

Another object of the present invention is to provide turbine components which can accommodate inlet temperatures above about 2400° F. without complex cooling measures for the aerodynamic surfaces of the blade.

Yet another object of the present invention is to provide a ceramic turbine blade which does not require a prohibitively large volume rate of cooling fluid.

An additional object of the present invention is to provide methods and apparatus for employing ceramic materials to form components of turbomachinery.

Another object of the present invention is to provide turbomachinery components having thermally-insulating shields or sleeves formed of ceramic materials which provide resistance against centrifugal and tensile forces.

The objects, advantages and novel features of the present invention will become apparent from the following detailed description of the invention when considered in conjunction with the accompanying drawings.

SUMMARY OF THE INVENTION

The present invention achieves these and other objects by providing a ceramic blade assembly which includes a corrugated-metal partition situated in the space between the ceramic blade element and the post member, which corrugated-metal partition forms a compliant layer for the relief of mechanical stress in the ceramic blade element during aerodynamic and thermal loading of the blade and which partition also serves as a means for defining contiguous sets of juxtaposed passages situated between the ceramic blade element and the post member for directing cooling fluid thereover and the second set being adjacent to the interior surfaces of the ceramic blade element and being closed-off for creating stagnant columns of fluid to thereby insulate the ceramic blade element from the cooling air.

DETAILED DESCRIPTION OF THE PREFERRED EMBODIMENT

Figure 1:
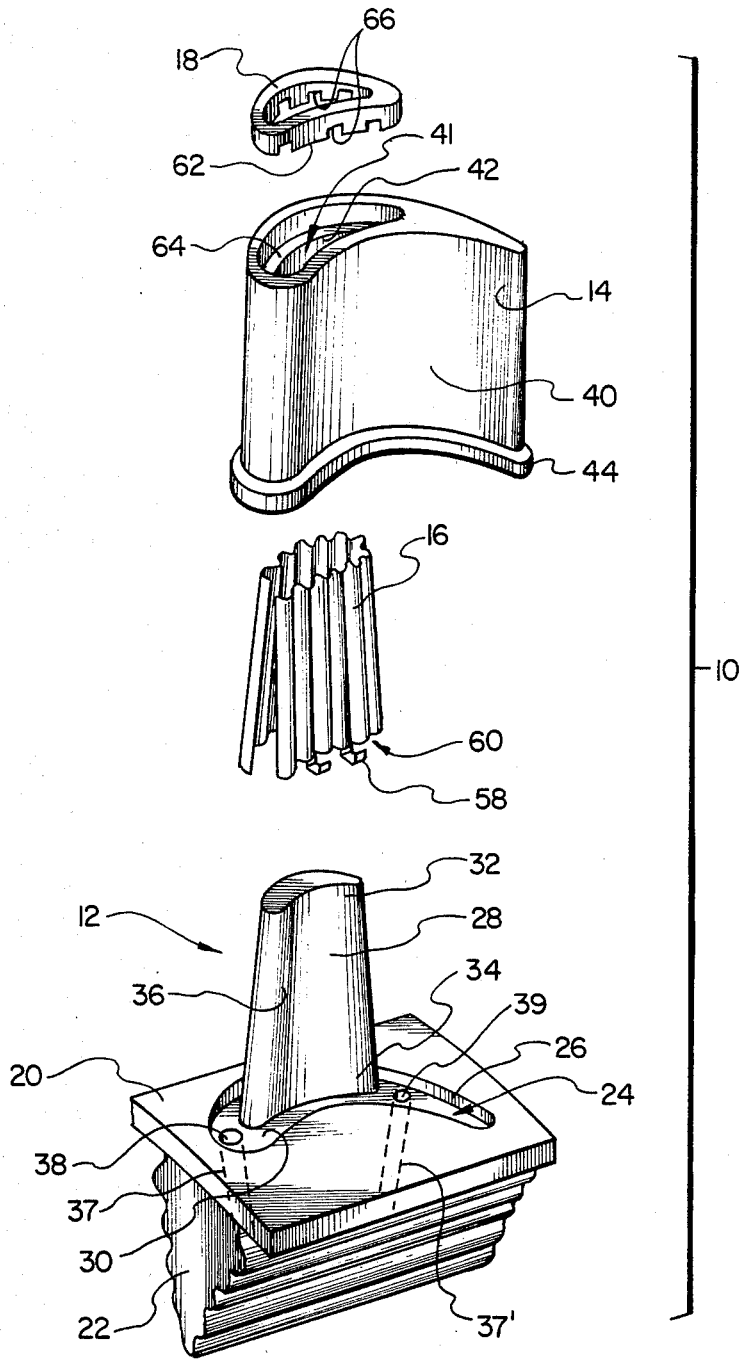
FIG. 1 is an exploded view of a blade assembly constructed according to the preferred embodiment of the present invention.

In accordance with the present invention, FIG. 1, shows an exploded view of the preferred embodiment of a ceramic turbine blade assembly, generally designated 10 which is suitable for attachment to a turbine rotor hub (not shown) having a plurality of slots at its peripheral edge for receiving blades. Ceramic blade assembly 10 comprises a base element generally designated 12, a ceramic blade element 14, resilient, corrugated partitions 16 and cap member 18. Base element 12 itself comprises a blade platform 20 from which extends on the underside a root section 22 for engagement with one of the slots provided in the turbine rotor. Base element 12 further comprises in the preferred embodiment, a recess 24 as defined by a rim 26 and a post member 28 extending from floor 30 of said recess 24. Post member 28 includes tip 32, post-root 34 and exterior surfaces 36. In the preferred embodiment post member 28 is integrally formed with floor 30. Passing through base element 12 are ducts 37 and 37' which deliver flows of cooling fluid at exits 38 and 39 in proximity to post-root 34.

Figure 2:
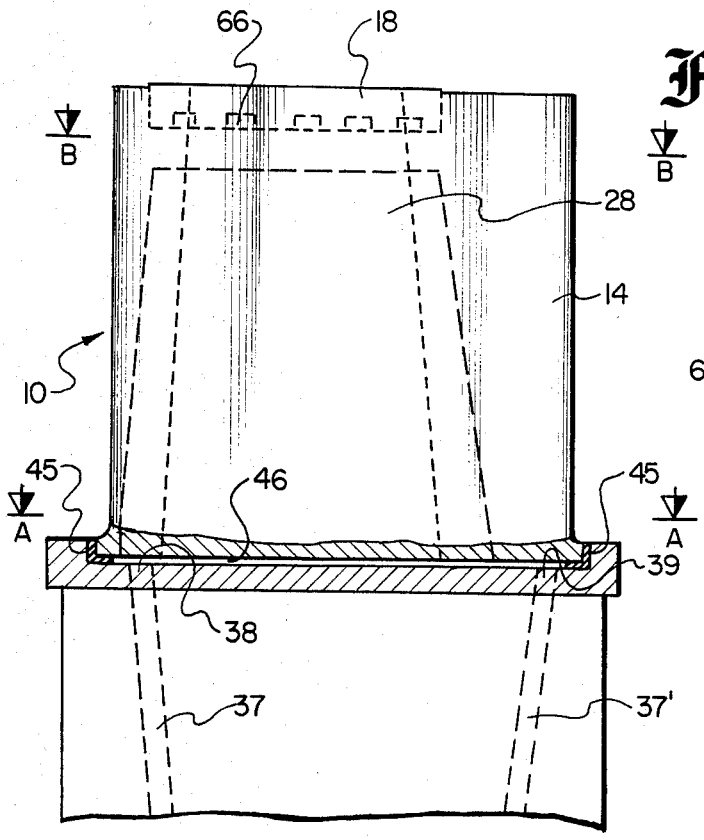
FIG. 2 is a side view of the blade assembly shown in FIG. 1.

A ceramic blade element 14 is provided having the aerodynamic surface 40 shaped to provide the desired aerodynamic configuration and formed with an internal span-wise channel 41 as defined by interior surfaces 42. Internal span-wise channel 40 is shaped to allow ceramic blade element 14 to slide easily over post member 28 and is shaped for providing a space between exterior surfaces 36 of post member 28 and interior surfaces 42 of ceramic blade element 14. Footing 44 of ceramic blade element 14 is suitably shaped to match rim 26 and to allow for placement of a compliant seal 45 therebetween. Seal 45 is preferrably constructed of nickel or cobalt base alloy or stainless steel as can best be appreciated by reference to FIG. 2. By such arrangement, ceramic blade element 14 is positioned apart from floor 30 to define a peripheral channel 46 about post-root 34.

Referring further to FIG. 1, ceramic blade assembly 10 also comprises resilient corrugated partitions 16, preferrably constructed of metallic alloys, stainless steel, Haynes 25 or a nickel-base super alloy, which function as a compliant layer for accommodating differential thermal expansion of post member 28 and ceramic blade element 14 and as a means for dampening vibration and cushioning aerodynamic loads on ceramic blade element 14 along its entire surfaces, including but not to the exclusion of others, aerodynamic surface 40 and interior surface 42.

Figure 4:
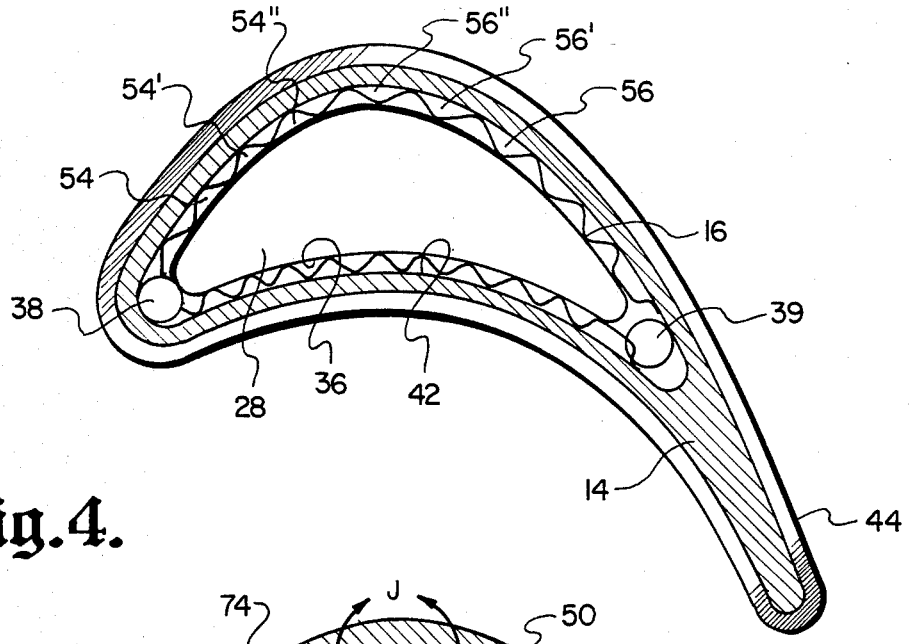
FIG. 4 is a top-sectional view of the blade taken at line A—A in FIG. 2.
Figure 5:
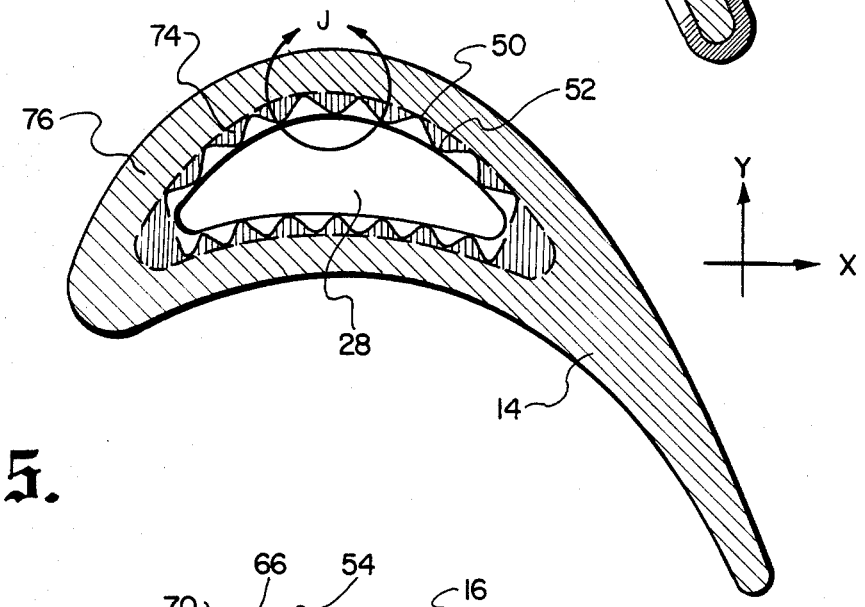
FIG. 5 is a top-sectional view of the blade taken at line B—B in FIG. 2.
Figure 6:
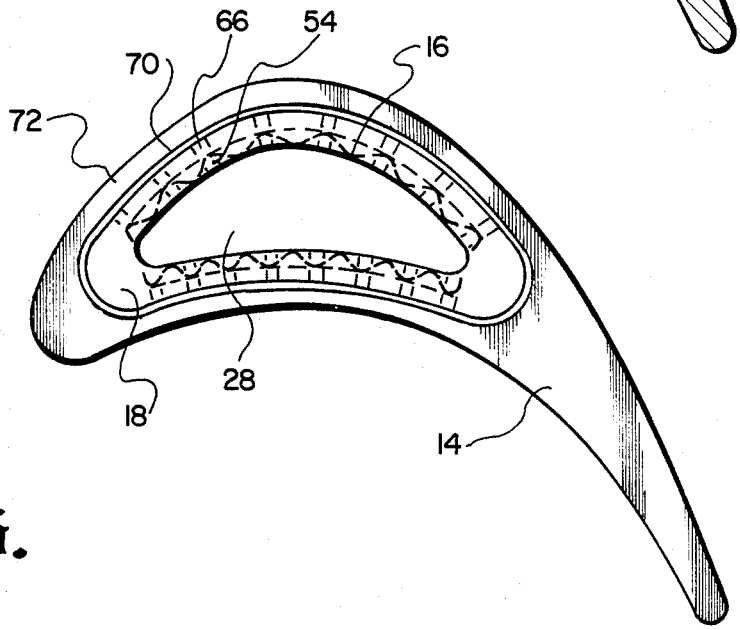
FIG. 6 is a top view of the blade shown in FIG. 2.

As can best be appreciated by reference to FIGS. 4, 5 and 6, resilient corrugated partitions 16 form alternating span-wise extending lines of contact 50 and 52 along interior and exterior surfaces 42 and 36, respectively. By reason of such contact and their resiliency, resilient corrugated partitions 16 dampen vibration and help distribute local loadings resulting from the angular and/or translational displacement of the ceramic blade element 14 with respect to the post member 28.

The translational deflections would be mostly in the directions indicated by x and y in FIG. 5 and the angular displacement would be mostly about an axis perpendicular to same. Resilient corrugated partitions 16 also define contiguous sets of juxtaposed passages as best appreciated by reference to FIG. 4 wherein is shown a first set of passages 54 which are adjacent to exterior surface 36 of post member 28 and a second set of pasages 56 which are adjacent to interior surfaces 42 of ceramic blade element 14. It is to be understood that first and second set of passages 54 and 56 are supplied a flow of cooling fluid through ducts 37 and 37' and peripheral channel 46 although second set of passages 56 are blocked-off so that cooling fluid does not flow therethrough, as will be described further below.

Figure 3:
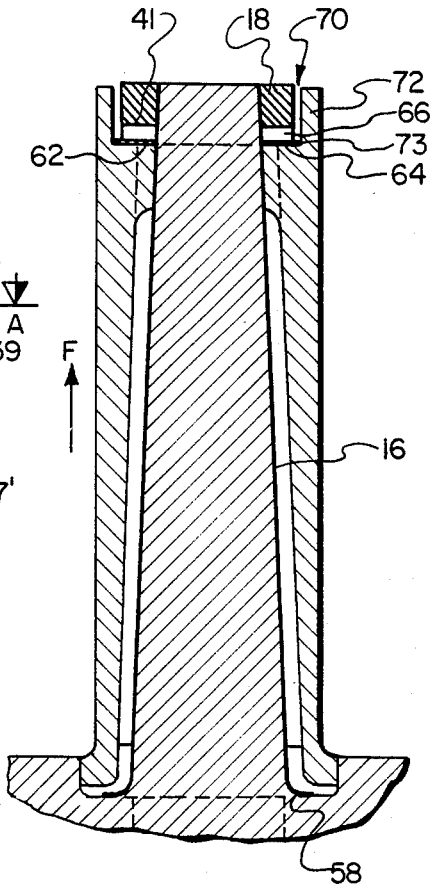
FIG. 3 is a frontal-section view of the blade assembly shown in FIG. 1.
Figure 8:
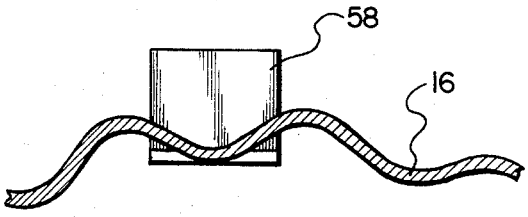
FIG.8 is a detailed edge view of a resilient corrugated partition including one of the biased feed thereof.

Referring back to FIG. 1 and also to FIG. 3, corrugated partitions 16 also comprise a plurality of biased feet 58 connected to the lower end 60 of corrugated partitions 16. Biased feet 58 fit only partially within peripheral channel 46 so that the flows of cooling fluid passing therethrough are not blocked off, as best can be appreciated by reference to FIG. 3. Biased feet 58 urge corrugated partitions 16 to an upward-most position towards cap member 18. This arrangement assures the positioning of corrugated partitions 16 so that balancing of the whole turbine rotor is maintained.

Referring to FIG. 1, cap member 18 is bonded to tip 32 of post member 28 by suitable means well-known to the art and includes bearing surface 62 which serves as an abutment to ceramic blade element 14 at edge 64 against centrifugal motion during turbine roll. When turbine rotor hub is rotated, ceramic blade element 14 will be forced against cap member under force F, and the tensile load will be carried by post member 28 and cap member 18. Thus ceramic blade element will be subjected only to compressive loads, which ceramics have been shown to bear very well.

Formed into bearing surface 62 of cap member 18 is a plurality of grooves 66, one each for juncturing with a respective member of the first set of passageways 54 as can best be understood by reference to FIG. 6. By such arrangement each of the flows of cooling fluid passing through a first set of passages 54 may exit therefrom through grooves 66 to ultimately escape through gap 70 between cap member 18 and top rim 72 of ceramic blade element 14. Top rim 72 also serves to protect cap member 18 from hot gasses flowing by ceramic blade element 14 during turbine roll, as can best appreciated by reference to FIG. 3. However, rim 72 could be omitted to allow for a larger bearing surface 62. In this case, the cooling fluid passing through grooves 66 maintain the cap 18 at acceptable temperatures. It is to be understood that the means for allowing cooling fluid to escape first set of passages 54 might include in the alternative grooves formed in edge 64 of ceramic element 14.

It is also preferred to place a layer of compliant material 73 between bearing surface 62 of cap member 14 and ceramic blade element 18 to protect the brittle ceramic material.

Figure 7:
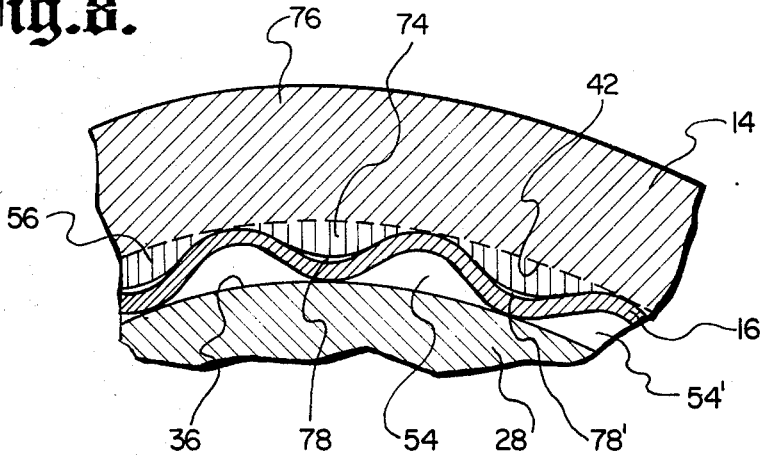
FIG. 7 is a detailed view of the area encircled at J in FIG. 5.

Referring now to FIGS. 5 and 7, the preferred embodiment also comprises corrugated ridges 74 along interior surfaces 42 of ceramic blade element 14 at a location preferably near tip 32. As can be appreciated best by reference to FIG. 7, corrugated ridges 74 are complementary shaped and positioned with respect to corrugated resilient partitions 16 to mesh therewith. By such arrangment, the second set of passages 56, which are adjacent to interior surfaces 42 become filled with stagnated fluid by reason of the blockage. In this manner, ceramic blade element 14 is thermally insulated from the effects of the cooling fluid passing through first set of passages 54.

It should be further understood that corrugated paritions 16 are preferrably sinusoidal in curvature and are deflected during assembly to create a flexible preload condition between ceramic blade element 14 and post member 28. The preloading is especially advantageous in allowing for the preloading of the ceramic blade element 14 against deflection due to vibration, aerodynamic loading or other mechanical disturbances along aerodynamic surfaces 40. As a result, ceramic blade element 14 can be made of walls 76 which are thinner than those otherwise feasible without the preloading while retaining capacity to withstand shock loading. Through practice to the present invention, the ceramic blade element 14 can be thinned to an extent that ceramic blade element 14 likens to a thin shell rather than a walled body. With thin walls 76, the temperature gradiant thereacross is minimized and the danger of thermal-stress failure in ceramic blade element 14 is reduced.

Referring again to FIG. 7, the preferred embodiment also provides for gaps 78 between corrugated partitions 16 and corrugated ridges 74 so that corrugated partitions can flex and provide cushioning to the bearing surfaces of corrugated ridges 74.

Obviously, numerous other variations and modifications may be made without departing from the present invention. Accordingly, it should be clearly understood that the forms of the present invention described above and shown in the accompanying drawings are illustrative only, and are not intended to limit the scope of the invention.

What is claimed and desired to be secured by Letters Patent of the United States is:

1. A ceramic blade assembly suitable for attachment to a turbine rotor hub comprising a disk having a plurality of shaped slots along the periphery of said disk for receiving individual turbine blades, said ceramic blade assembly comprising:

a base element comprising means for affixing said base element to said turbine rotor hub at said slots, a platform portion affixed to said engagement means, said platform portion having rim means for defining a recess in said platform for receiving the footing of a blade element, said defined recess having a floor, and a post member affixed to and extending from said floor of said platform portion, said post member having a post-root, a tip and exterior surfaces;

a ceramic blade element comprising an airfoil shaped body having interior surfaces for defining an internal span-wise channel for receiving said post member and rim means for defining a footing for engagement with said rim means of said base element, said ceramic blade element being positioned about said post member so that said interior surfaces are at least partly set apart from said exterior surfaces of said post member and so that said ceramic blade element is set apart from said floor of said platform portion to define a peripheral channel about said post-root;

a cap means affixed to said tip of said post member, said cap having at least one bearing surface for retaining said ceramic blade element in position about said post member;

at least one resilient corrugated partition positioned between and in contact with said interior and exterior surfaces, said resilient corrugated partition defining contiguous sets of juxtaposed passages situated between said ceramic blade element and said post member, said sets of passages being in communication with said peripheral channel and said sets including a first set of passages open to said exterior surfaces of said post member and a second set of passages open to said interior surfaces of said ceramic blade element;

means for supplying cooling fluid to said first set of passages through said peripheral channel;

means for exiting said cooling fluid from said first set of passages at said tip; and means for forming columns of stagnated fluid within said second set of passages to insulate said ceramic blade element.

2. A ceramic blade assembly suitable for attachment at turbine rotor hub, comprising:

a post member having a base, a tip and exterior surfaces;

means for affixing said post member to said rotor hub;

a ceramic blade element comprising an airfoil shaped body having interior surfaces for defining an internal span-wise channel for receiving said post member, said ceramic blade element being positioned about said post member so that said interior surfaces are at least partly set apart from said exterior surfaces of said post member;

a cap means affixed to said tip of said post member, said cap having at least one bearing surface for retaining said ceramic blade element in position about said post member;

at least one resilient corrugated partition positioned between and in contact with said interior and exterior surfaces, said corrugated partition defining contiguous sets of juxtaposed passages situated between said ceramic blade element and said post member, said sets including a first set of passages open to said exterior surfaces of said post member and a second set of passages open to said interior surfaces of said ceramic blade element, said second set insulating said ceramic blade element;

means for delivering a flow of cooling fluid to said first set of passages from said base; and means for exiting cooling fluid from said first set of passages at said tip.

3. A ceramic blade assembly as claimed in claim 1 or 2 wherein said affixing means is a fir tree root section.

4. A ceramic blade assembly as claimed in claim 2 wherein said affixing means is an integral connection between said rotor hub and said post member.

5. A ceramic blade assembly as claimed in claim 1 or 2 wherein said exit means comprises a plurality of grooves in said bearing surface of said cap which communicate with members of said first set of passages.

6. A ceramic blade assembly as claimed in claim 2 wherein said ceramic blade assembly further comprises means for closing-off said second set of passages so that columns of stagnated fluid can be formed within said second set of passages.

7. A ceramic blade assembly as claimed in claim 6 wherein said means for closing-off said second set of passages comprises corrugated ridges along said interior surfaces, said corrugated ridges being complementarily shaped and positioned with respect to said corrugated resilient partition to fixedly and blockingly mesh therewith.

8. A ceramic blade assembly as claimed in claim 7 wherein said corrugated ridges are in proximity of said tip.

9. A ceramic blade assembly as claimed in claim 1 or 2 wherein said ceramic blade assembly further comprises means for urging said corrugated partition in upward most position towards said cap member.

10. A ceramic blade assembly as claimed in claim 9 wherein said urging means are a plurality of biased feet members extending from said corrugated partition member.

11. A ceramic blade assembly comprising: a post member; a ceramic blade element positioned about and set apart from said post member; at least one resilient corugated partition positioned between and in contact with both said ceramic blade element and said post member, said corrugated partition having a first side open to said post member and a second side open to said ceramic blade element; and means for passing cooling fluid along said first side to cool said post member.

12. A ceramic blade assembly as claimed in claim 11 wherein said ceramic blade assembly further comprises means for creating stagnated columns of cooling fluid on said second side of said partition to insulate said ceramic blade element.

13. A ceramic blade assembly as claimed in claim 1 wherein said means for closing-off said second set of passages comprises corrugated ridges along said interior surfaces, said corrugated ridges being complementarily shaped and positioned with respect to said corrugated resilient partition to fixedly and blockingly mesh therewith.

14. A ceramic blade assembly as claimed in claim 6 wherein said corrugated partition is preloaded against deflection.

15. A ceramic blade assembly as claimed in claim 12 wherein said corrugated partition is preloaded against deflection.

16. A ceramic blade assembly as claimed in claim 7 wherein said corrugated ridges and said corrugated partition form gaps therebetween to provide cushioning for said corrugated ridges.

17. A ceramic blade assembly as claimed in claim 13 wherein said corrugated ridges and said corrugated partition form gaps therebetween to provide cushioning for said corrugated ridges.

* * * * *